US009427617B2

(12) United States Patent
Cojocaru

(10) Patent No.: US 9,427,617 B2
(45) Date of Patent: Aug. 30, 2016

(54) EXERCISE BAR AND METHOD

(71) Applicant: Bogdan Cojocaru, Ottawa (CA)

(72) Inventor: Bogdan Cojocaru, Ottawa (CA)

( * ) Notice: Subject to any disclaimer, the term of this patent is extended or adjusted under 35 U.S.C. 154(b) by 84 days.

(21) Appl. No.: 13/963,349

(22) Filed: Aug. 9, 2013

(65) Prior Publication Data

US 2014/0121074 A1 May 1, 2014

(51) Int. Cl.

| | |
|---|---|
| ***A63B 21/00*** | (2006.01) |
| ***A63B 21/072*** | (2006.01) |
| ***A63B 21/075*** | (2006.01) |
| ***A63B 23/12*** | (2006.01) |

(52) U.S. Cl.

CPC ..... *A63B 21/0724* (2013.01); *A63B 21/0004* (2013.01); *A63B 21/075* (2013.01); *A63B 23/12* (2013.01); *A63B 23/1209* (2013.01); *A63B 23/1218* (2013.01); *A63B 23/1236* (2013.01); *A63B 23/1263* (2013.01)

(58) Field of Classification Search

CPC ..... A63B 21/00
USPC ..... 482/35, 41, 106, 108, 109
See application file for complete search history.

(56) References Cited

U.S. PATENT DOCUMENTS 3,662,080 A * 5/1972 Hale et al. ..... 84/477 B
3,810,411 A * 5/1974 Schambacher ..... 84/477 B

* cited by examiner

*Primary Examiner* — Jerome W Donnelly

(57) ABSTRACT

The present invention provides an improved exercise bar and method for dynamically training muscles using multi-axial, multi-planar and multi-directional movements. The present improved exercise bar has a cylindrical, axially extending handle section, a first weighted end and a second weighted end, such that each weighted end has a greater mass than a section of the handle section of equal length.

13 Claims, 14 Drawing Sheets

A

B

C

EXERCISE BAR AND METHOD

FIELD OF THE INVENTION

The present invention relates to exercise apparatuses and methods for using them. More specifically, the present invention relates to an improved exercise bar and a method for using the present improved exercise bar.

BACKGROUND OF THE INVENTION

Strength training through lifting weights is a popular exercise regimen that promotes muscle growth, joint and tendon strengthening and bone development, among various other health benefits. Weight training equipment includes traditional free weights (using barbells and dumbbells in combination with disc or plate weights) or specially designed resistance training machines that employ rubber bands, springs or weights to create resistance such that a user can specifically isolate particular muscle groups for training.

While resistance-training machines are designed to better isolate muscles, the free weights can be used for more complex movements that recruit a larger number of muscle groups. For example, a "Seated Knee Extension" exercise performed on a plate or disc-loaded machine is mostly designed to work the quadriceps group, while a barbell squat works the quadriceps, all the thigh and lower leg muscles plus the gluteal muscles, and the back extensors along with other trunk muscles.

However, even though traditional free weight exercises engage more muscle groups per movement when compared with resistance training machines, they are limited in the aspect that most of the movements performed with the free weights are unidirectional and occur mostly around one dominant joint axis and one dominant plane of motion at a time. This is often true even in the case of multi joint exercises. For example, in a "Shoulder Press" exercise performed with dumbbells or barbells, the movement is occurring in the frontal (coronal plane) of the body while the axes of rotation remain unchanged respectively antero-posterior for both the shoulder and the elbow joint.

However, it is well known that many every day human movements, as well as many athletic activities, require that the body functions using multiple joint axes and planes of motion at certain instants. Even though this synergistic modality of resolving various force opposition scenarios occurs naturally and is often preferred to isolation strategies, there is no current apparatus and method of training specifically designed for it.

The present disclosure provides an apparatus and associated method that can be utilized effectively to put under load a variety of multi-planar, multi-axial and multi-directional movements for the purpose of improving muscle and joint health and performance.

The movements performed with traditional free weights consist mostly of pushing or pulling the weight in different directions. In contrast, the movements performed with the present apparatus and method include a variety of spinning, swinging, and rapid accelerations in various directions, and throwing or catching movements which can be multi-planar relative to the space, multi-axial relative to the involved joints and multi-directional relative to the apparatus movements.

By way of example, the "Kayak Bar Spin" is an exercise that combines movements of the body and the bar in all three planes of motion. In the start position, the bar is held in front of the chest with the elbows bent at 90° using a pronated grip, while the body is upright with the feet placed shoulder width apart and the knees slightly bent. In the first part of the exercise, the following movements occur: bilateral knee bend; right to left weight transfer; left trunk rotation and side bend; right arm flexion, adduction and internal rotation; left arm extension, abduction and external rotation. The exercise then continues with a further bilateral knee bend, left arm flexion, abduction and external rotation. Then, the bar is pushed in front of the body while rotating the trunk towards the right side and reversing the movements previously described.

As can be readily appreciated, the number of muscles involved in this exercise are far greater due to the multitude of movements involved when compared to the traditional bar push or pull exercises; i.e., "Shoulder Press", "Chest Press", "Bicep Curls", etc.

A commonly used exercise bar is the Olympic bar, which weighs about 45 lb (approximately 20.41 kg) with a standard length of 7 ft (approximately 213.36 cm). Because of its heavy weight and length, the Olympic bar is not suitable for training many beginners or people recovering from injuries. An Olympic bar is also not secure to be swung and spun when loaded with plates. Even if the plates were secured tightly to the bar, the Olympic bar would be too heavy for most people to safely spin. Moreover, because of the wide diameter of the plate weights, a loaded Olympic bar would have to be rotated further away from the body in order to clear the body. Furthermore, the ends of the Olympic bar are cylindrical components designed to be loaded with plate weights and to rotate about the longitudinal axis of the bar.

Therefore, an Olympic bar cannot be gripped effectively about its ends as it would not be suitable to transmit torque when rotated about its longitudinal axis. With respect to the grip surface, an Olympic bar has an engraved pattern on its grip portions that is quite rough in comparison to the smooth surface of the rest of the bar. This design is a result of the fact that the Olympic bar is contemplated for use in exercises where the hands remain in a stationary position during the course of the exercise. Finally, the Olympic bar has sharp, defined edges that could damage a floor when coming in contact with it. The sharp edges also make it difficult to tilt when the bar is upright with one end on the ground.

Therefore, there is a need for an improved exercise bar that addresses these deficiencies of the Olympic bar. More specifically, there is a need for an improved exercise bar that is easy to handle with limited abrasion, can be rotated about its longitudinal axis or supported by one end on the ground, and can be sized such that it can be used effectively by a wide variety of users with different training needs.

The present invention overcomes the characteristics of the Olympic bar mentioned above. The present apparatus can be manufactured with a lighter weight, shorter length and a more versatile grip than the Olympic bar. The weight can vary from approximately 8 lb (approximately 3.63 kg) to 80 lb (approximately 36.28 kg) and the length can vary from 1½ ft (approximately 45.75 cm) to 8 ft (approximately 243.84 cm). When gripped at the ends, the present apparatus transmits the forces from the body to the bar and vice versa in all directions, including the rotation around its longitudinal axis because the bar is made, at least in one embodiment, from one continuous piece and the ends are fixed with respect to the longitudinal axis. Also, because the present apparatus is not loaded with additional weights, it is both safer and more effective to use in swinging and spinning movements due to its compact shape and design than the plate-loaded Olympic bar.

Furthermore, the present apparatus provides a smoother grip surface that can permit moving the hands as needed during an exercise by sliding them from a first position to a second position along the shaft without causing undue damage due to friction. An example of this grip change will be discussed in greater detail in connection with the drawings presented herein. Finally, the present apparatus has, in at least one embodiment, rounded spherical edges on both ends which can allow rotation or translation of the bar without damaging the surface with which it comes in contact.

A "Straight Bar" is another piece of exercise equipment commonly used in weight training. The straight bars can vary in weight and length but they have one common characteristic; that is that they have the same diameter across their whole length. It is well known that in order to rotate a weight placed farther away from the centre of rotation, it requires more effort and therefore more work than if the weight to be rotated is placed closer to the centre of rotation.

When compared to the straight bar, the present apparatus has the weight distributed further away from the centre of rotation and therefore when spun around its centre of rotation, it can require a larger number of muscles and/or a more intense contraction of the same muscles. Therefore, the muscle recruitment is higher when using the present apparatus.

Plyometric exercises are also well known to develop speed, power and explosiveness but they are mostly performed using body weight. Currently, there are no weighted exercise apparatuses that are specifically contemplated for use in connection with plyometric exercises. This is largely because existing free weights are too heavy, unsafe or inconvenient to use in connection with such rapid and repetitive plyometric movements.

Further, there is a lack of simple exercise apparatuses that are specifically designed for both multi-planar and plyometric strength training exercises. There is a need for an exercise bar of unitary construction and functional design for use in connection with a wide variety of dynamic, multi-axial, multi-planar and plyometric strength training exercises.

SUMMARY OF THE INVENTION

The present invention provides, in at least one embodiment, an improved exercise bar having an axially extending cylindrical handle section having a first end and a second end, a first frustoconical end, the first frustoconical end having a first end abutting the first end of the handle section and a distal end, a second frustoconical end, the second frustoconical end having a first end abutting the second end of the handle section and a distal end, such that each of the first frustoconical end and the second frustoconical end have a greater mass than a section of the handle section of the same length.

In another embodiment, the present invention provides a method of exercising muscles and improving the body's force transmission capabilities by strategically utilizing progressive multi-planar, multi-axial and multi-directional resistance by way of manipulating an improved exercise bar, the exercise bar having an axially extending, cylindrical handle section having a first end and a second end, a first frustoconical end, the first frustoconical end having a first end abutting the first end of the handle section and a distal end, a second frustoconical end, the second frustoconical end having a first end abutting the second end of the handle section and a distal end, such that each of the first frustoconical end and the second frustoconical end have a greater mass than a section of the handle section of the same length.

In another embodiment, the present invention provides a method of dynamically exercising a targeted muscle, the method having the steps of exercising the targeted muscle in at least two planes of motion relative to a skeletal joint adjacent to the targeted muscle by selecting the appropriate loading scenario according to current available range of motion, quality of motion characteristics and muscular ability to tolerate force by using an improved exercise bar, the exercise bar having an axially extending, cylindrical handle section having a first end and a second end, a first frustoconical end, the first frustoconical end having a first end abutting the first end of the handle section and a distal end, a second frustoconical end, the second frustoconical end having a first end abutting the second end of the handle section and a distal end, such that each of the first frustoconical end and the second frustoconical end have a greater mass than a section of the handle section of the same length.

In another embodiment, the present invention provides a method of exercising targeted muscles by using exercises specifically designed to improve the body's force transmission capabilities, the method having the steps of a range of motion assessment, a quality of motion assessment, a strategic utilization of progressive multi-planar movements under load, by way of manipulating an improved exercise bar, a strategic utilization of multi-axial movements put under load by the improved exercise bar, a strategic utilization of multi-directional movements put under load by way of manipulating the improved exercise bar, exercising the targeted muscles synergistically and under progressive loading relative to the involved skeletal joints by manipulating the improved exercise bar, the improved exercise bar having an axially extending, cylindrical handle section having a first end and a second end, a first frustoconical end, the first frustoconical end having a first end abutting the first end of the handle section and a distal end, a second frustoconical end, the second frustoconical end having a first end abutting the second end of the handle section and a distal end, wherein each of the first frustoconical end and the second frustoconical end have a greater mass than a section of the handle section of the same length.

In another embodiment, the present invention provides a method of using an exercise system by a user having the steps of a user moving an improved exercise bar of the exercise system; the user supplying a force to generate a selected movement of the improved exercise bar to dynamically train targeted muscles, the movement configured to manipulate the improved exercise bar under progressive loading in multiple planes relative to adjacent joints of the targeted muscles.

In another embodiment, the present invention provides a method of assessment of a motion characteristic of targeted muscles having the steps of performing an assessment of motion characteristic, determining limitations of the motion characteristic, comparing the limitations of the motion characteristic to a predetermined threshold, if the limitations of the motion characteristic do not exceed a predetermined threshold, selecting an exercise for dynamically training the targeted muscles in multiple planes relative to adjacent skeletal joints.

Preferred embodiments will now be described in greater detail and will be better understood when read in conjunction with the following drawings.

DETAILED DESCRIPTION OF THE PREFERRED EMBODIMENTS

The present invention provides an improved exercise bar that is specifically contemplated for use in connection with plyometric exercises and specially designed for multi-planar, multi-axial and multi-directional dynamic weight training exercises that apply a progressive resistance in a variety of unique loading scenarios. These exercises may be tailored to each individual according to his or her pre-existing health conditions, medical history and training goals.

The improved exercise bar of the present invention is particularly effective in transmitting the force of gravity to the user's muscles, as there are no moving parts that can dissipate kinetic energy. Potential energy can also be used more effectively in a multitude of directions. This results in a more efficient strength training workout when compared to existing solutions.

Further, the improved exercise bar of the present invention is particularly well suited for rotation about a number of axes, which can result in a particularly effective strength training regimen. This is in contrast to Olympic bars and barbells, which are not well suited to safe rotation as they employ weight plates which are secured by simple screw collars or other quick release mechanisms.

The improved exercise bar of the present invention can be manufactured by any suitable process, including but not limited to casting, milling and lathing, among other processes that will be known to the skilled person. Similarly, the improved exercise bar of the present invention may be manufactured of any suitable material, including but not limited to aluminum, stainless steel, carbon steel and galvanized steel among other materials that will be known to the skilled person.

In at least one embodiment the improved exercise bar is manufactured of one unitary piece; however, it is also contemplated that the improved exercise bar is manufactured of separate components suitably joined together.

As discussed above, in at least one embodiment the improved exercise bar is manufactured of a solid piece of material. In other embodiments, the improved exercise bar can have a central core manufactured of a material having different physical properties than the material used as an outer surface. For example, the improved exercise bar may have a central, solid core of a high-density material (such as steel) and an outer surface of a softer, lower density material such as foam rubber or plastic. In this way, the improved exercise bar can have the requisite physical qualities (particularly strength and weight) while having more desirable tactile qualities.

The improved exercise bar of the present invention has a central, cylindrically shaped handle section that has a first end and a second end. Further, a first weighted end and a second weighted end are respectively connected to the first end and the second end of the handle section.

Figure 1:
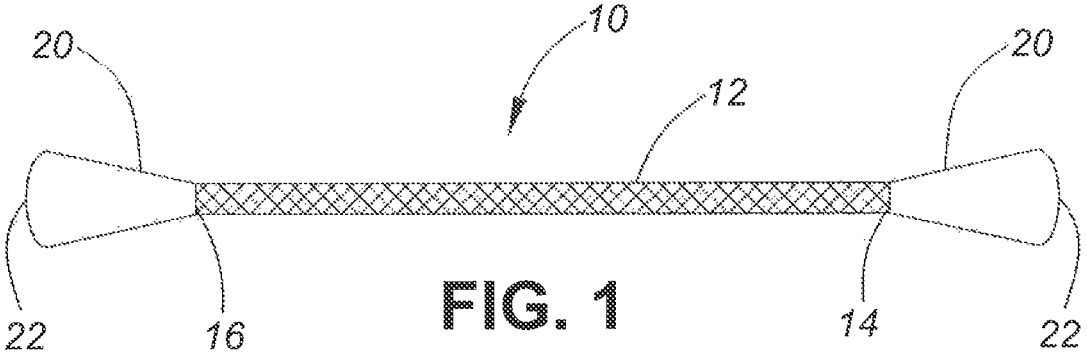
FIG. 1 is a side view of at least one embodiment of an exercise bar in accordance with the present disclosure.
Figure 2:
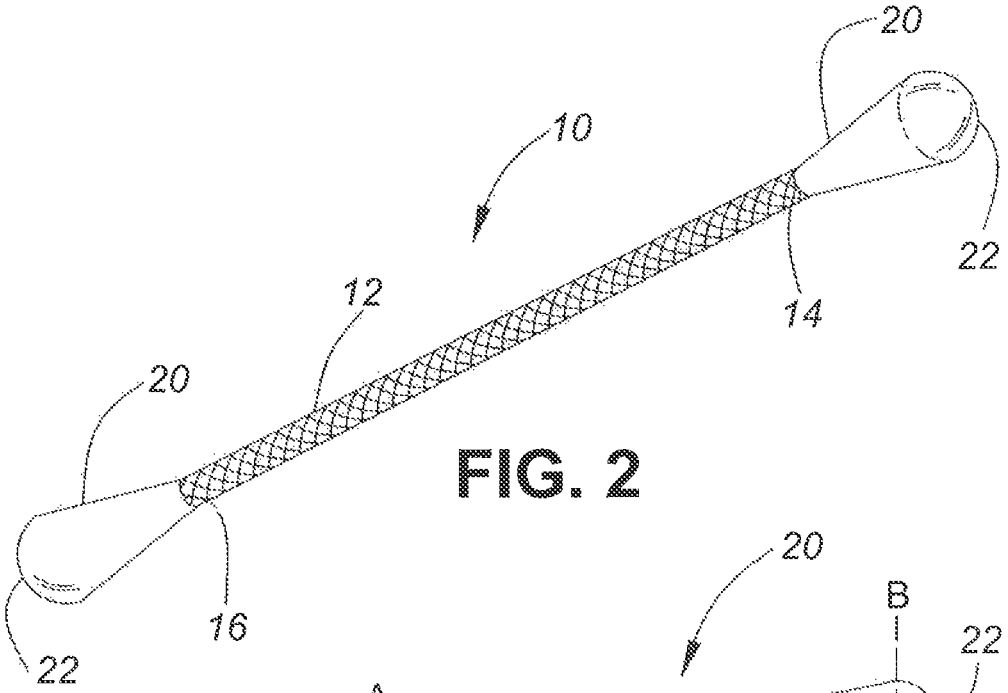
FIG. 2 is a perspective view of the exercise bar of FIG. 1.

Turning to FIGS. 1 and 2, at least one embodiment of an improved exercise bar 10 is illustrated. Exercise bar 10 has a handle portion 12, first end 14 and a second end 16. Handle portion 12 is cylindrically shaped and extends longitudinally along the axial axis of exercise bar 10.

In some embodiments, the outer surface of handle portion 12 may be knurled or rubberized to improve the tactile qualities of the handle portion. In other embodiments, handle portion may have a smooth finish.

Handle portion 12 may be solid, hollow, or composed of dual density materials as the needs of a particular application may require. In applications where the exercise bar is required to be relatively light, handle portion 12 may be of hollow construction or alternatively may have a core that is constructed of a lower density material than the outer surface of handle portion 12. In applications where the exercise bar is required to be relatively heavy, handle portion 12 may be of solid construction, or alternatively, may have a core that is constructed of a higher density material than that of the outer surface of handle portion 12.

In at least one embodiment, handle portion 12 is knurled to provide additional grip. In other embodiments, handle portion 12 may be rubberized or covered in a material that provides improved tactile qualities such as additional grip or a degree of shock absorption.

It is contemplated that handle section 12 can be manufactured to any dimensions as required by the intended application. For example, a longer, larger diameter handle section 12 (and resultant exercise bar 10) may be manufactured for the use of professional athletes, while a shorter, smaller diameter handle section 12 and exercise bar 10 may be more suitable for use in a home gym. Similarly, the weight of exercise bar 10, handle section 12 and the weighted ends (discussed below) may be manufactured to any mass suitable for the intended application, provided that each weighted end is heavier than a section of handle 12 of the same length.

A weighted end 20 is attached to each end (14, 16) of handle portion 12. Weighted end 20 can be attached to handle portion 12 by any suitable means, including welding, mechanical fastening, or forming the entire exercise bar out of a single piece of material (as discussed above), among other means for attaching the weighted ends to the handle portion that will be apparent to the skilled person.

Each weighted end 20 is designed such that it has a greater mass than a section of handle section 12 of the same length, as will be understood by the skilled person. This can be accomplished in a number of ways, such as manufacturing each weighted end out of a solid material and joining it to a handle section of hollow material. Alternatively, the weighted ends could have a high-density internal core.

Figure 3:
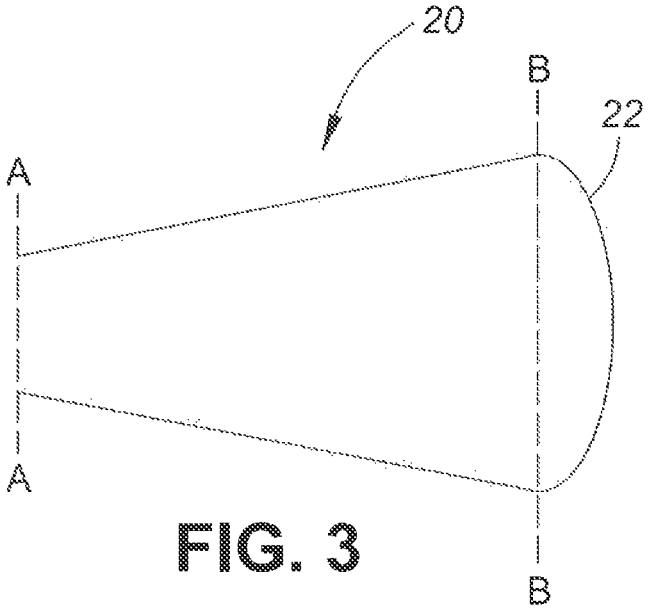
FIG. 3 is a close up view of a weighted end of the exercise bar of FIG. 1.

In at least one embodiment and as seen in FIGS. 1 to 3, each weighted end 20 is shaped such that a weighted end occupies a larger volume of space than a section of handle section 12 of the same length. Therefore, if handle section and weighted end is manufactured of the same material (having constant density), weighted end 20 will have a greater mass than a section of handle section 12 of the same length.

Weighted end 20 can be formed of a variety of shapes, such as conical, spherical, cylindrical, spheroid, ovoid, rectangularly parallelepiped and triangularly prismatic, among other shapes that will be readily apparent to the skilled person. As seen in FIG. 3, weighted end 20 can be shaped as a conical section such that it has a first diameter equal to the handle portion at a first point A-A, and a second diameter larger than the first diameter at some point B-B distally removed from the first point A-A.

Embodiment

Improved Exercise Bar with Frustoconical Ends

In at least one embodiment, weighted end 20 is frustoconically shaped having a proximal end that abuts end 14, 16 of handle section 12 and a distal end 22 as seen in FIG. 3. Distal end 22 can take a wide variety of shapes including but not limited to convex, concave, outwardly conical, inwardly conical and flat. In at least one embodiment, weighted end 20 has a distal end that is outwardly convex, as shown in FIG. 3.

In at least one embodiment, weighted end 20 is a frustoconical end having a length of 30 cm. In this embodiment, the frustoconical end can have a diameter of 2.8 cm at a position where the frustoconical end abuts the handle section (0 cm position), a diameter of 3.2 cm at a position 5 cm away from where the frustoconical end abuts the handle section (5 cm position), a diameter of 3.45 cm at a position 10 cm away from where the frustoconical end abuts the handle section (10 cm position), a diameter of 3.6 cm at a position 15 cm away from where the frustoconical end abuts the handle section (15 cm position), a diameter of 3.85 cm at a position 20 cm away from where the frustoconical end abuts the handle section (20 cm position), a diameter of 4.55 cm at a position 25 cm away from where the frustoconical end abuts the handle section (25 cm position), and a diameter of 4.95 cm at a position 30 cm away from where the frustoconical end abuts the handle section (30 cm position).

In at least one embodiment, weighted end 20 is a frustoconical end having a length of 30 cm. In this embodiment, the frustoconical end can have a diameter of 2.75 cm at a position where the frustoconical end abuts the handle section (0 cm position), a diameter of 3.15 cm at a position 5 cm away from where the frustoconical end abuts the handle section (5 cm position), a diameter of 3.4 cm at a position 10 cm away from where the frustoconical end abuts the handle section (10 cm position), a diameter of 3.75 cm at a position 15 cm away from where the frustoconical end abuts the handle section (15 cm position), a diameter of 4.1 cm at a position 20 cm away from where the frustoconical end abuts the handle section (20 cm position), a diameter of 4.7 cm at a position 25 cm away from where the frustoconical end abuts the handle section (25 cm position), and a diameter of 4.95 cm at a position 30 cm away from where the frustoconical end abuts the handle section (30 cm position).

In at least one embodiment, weighted end 20 is a frustoconical end having a length of 30 cm. In this embodiment, the frustoconical end can have a diameter of 2.8 cm at a position where the frustoconical end abuts the handle section (0 cm position), a diameter of 3.25 cm at a position 5 cm away from where the frustoconical end abuts the handle section (5 cm position), a diameter of 3.80 cm at a position 10 cm away from where the frustoconical end abuts the handle section (10 cm position), a diameter of 4.25 cm at a position 15 cm away from where the frustoconical end abuts the handle section (15 cm position), a diameter of 4.4 cm at a position 20 cm away from where the frustoconical end abuts the handle section (20 cm position), a diameter of 4.65 cm at a position 25 cm away from where the frustoconical end abuts the handle section (25 cm position), and a diameter of 4.85 cm at a position 30 cm away from where the frustoconical end abuts the handle section (30 cm position).

In at least one embodiment, weighted end 20 is a frustoconical end having a length of 30 cm. In this embodiment, the frustoconical end can have a diameter of 2.95 cm at a position where the frustoconical end abuts the handle section (0 cm position), a diameter of 3.55 cm at a position 5 cm away from where the frustoconical end abuts the handle section (5 cm position), a diameter of 4 cm at a position 10 cm away from where the frustoconical end abuts the handle section (10 cm position), a diameter of 4.4 cm at a position 15 cm away from where the frustoconical end abuts the handle section (15 cm position), a diameter of 4.95 cm at a position 20 cm away from where the frustoconical end abuts the handle section (20 cm position), a diameter of 4.95 cm at a position 25 cm away from where the frustoconical end abuts the handle section (25 cm position), and a diameter of 4.95 cm at a position 30 cm away from where the frustoconical end abuts the handle section (30 cm position).

In this way, the force of gravity creates a torque on exercise bar when it is held by handle section 12. As will be understood by the skilled person, if exercise bar 10 is held directly in the middle of handle section 12, the torque generated by the weight of each weighted end 20 will be equal and opposing, however if exercise bar 10 is held by a user at any other point on handle section 12, these torques will be unbalanced. This unbalanced torque may be utilized in wider variety of exercises to train muscles in dynamic and plyometric ways.

Similarly, if exercise bar 10 is rotated by a user about a rotational axis that is unparallel to the axial axis of the exercise bar, rotational torques are generated that can also be used to train muscles in dynamic and plyometric ways.

In at least one embodiment, exercise bar 10 has two identically shaped weighted ends 20, as shown in FIGS. 1 and 2, however it is also contemplated that exercise bar 10 could have two different weighted ends of different masses or of different shapes, depending on the needs of a particular application.

It is contemplated that the weight of the weighted ends can be varied by adding additional mass in the form of specially shaped plates or inserts that can be attached to weighted end 20 by any contemplated means. For example, additional mass could be added to the weighted end by way of a weighted screw plug that threads into a socket provided on distal end 22, among other arrangements.

Alternatively, each weighted end could have an internal chamber that can contain material such as sand or lead shot. In this way, the mass of the weighted end could be varied by altering the amount of material contained within the internal chamber.

Embodiment

Method of Exercising

In this way, the present invention provides an improved exercise bar that, when used in connection with a wide variety of both traditional and novel weight training exercises, can result in a more dynamic and diverse workout that can be specifically targeted towards improving the body force transmission capabilities and dynamic postural control. The unbalanced torques created when the exercise bar is moved or rotated about a transverse, lateral or radial axis serves to strengthen muscles in a multi-directional manner when considered relative to the joints involved in the movement.

Similarly, the present invention is particularly well suited to rotation about a radial, transverse or perpendicular axis relative to the axial axis of the exercise bar. The present invention has no moving parts or removable plate weights that could become loose or dislodged when the exercise bar is rotated about any of these axes. In this way, the present exercise bar can be safely employed in a wide variety of exercises that require rotation of the bar about all the axes and in a multitude of planes of motion.

Embodiment

Standing Basic Bar Rotation

Figure 4:
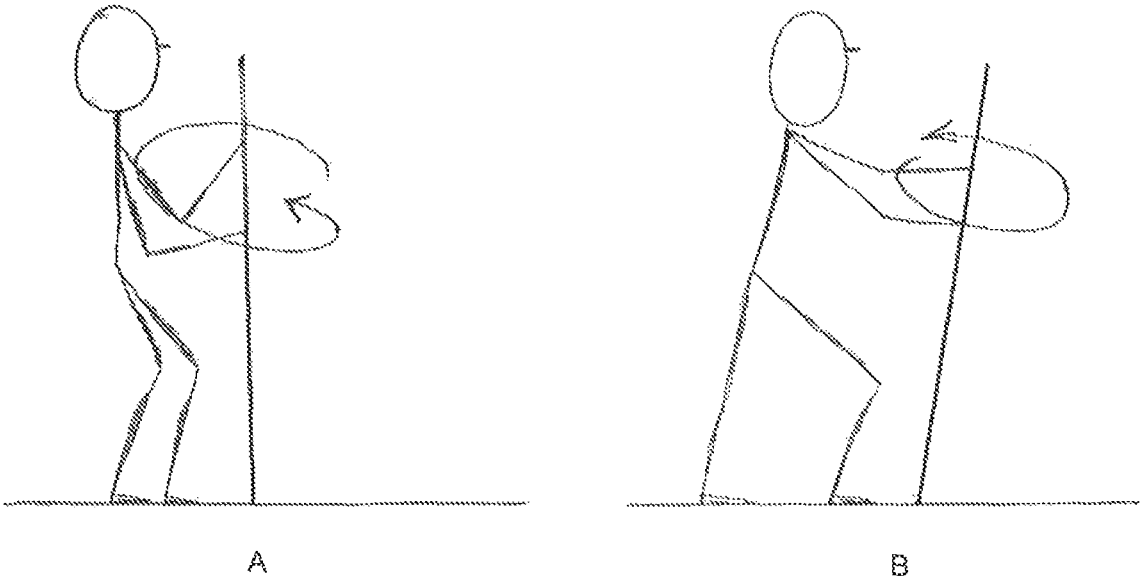
FIG. 4 is a diagrammatic representation of one embodiment of a method of exercising in accordance with the present disclosure.

With reference to FIG. 4, at least one embodiment of a method of exercising is illustrated wherein the present improved exercise bar is used to execute movements wherein one end of the bar is placed on the ground.

This embodiment can be termed a "Standing Basic Bar Rotation" exercise, wherein the present improved exercise bar is held perpendicular with the ground and with one end in permanent contact with it. Initially, FIG. 4A, the feet are shoulder-width apart with the knees slightly bent. The arms are also slightly bent at the elbows and gripping the bar with one arm at the solar plexus/upper chest level and the other gripping the bar at the naval level.

Then, FIG. 4B, the bar is being rotated in front of the body while the following movements occur. As the bar is rotated away from the body, there is an increased ankle dorsiflexion, knee, hip and trunk flexion, bilateral arm flexion and elbow extension accompanying the bar movement of rotation. As the bar is rotated towards the body, the previous movements are reversed into bilateral plantar flexion, knee, hip and trunk extension, bilateral arm extension set and elbow flexion.

Embodiment

Frontal Plane Bar Curl Rotation

Figure 5:
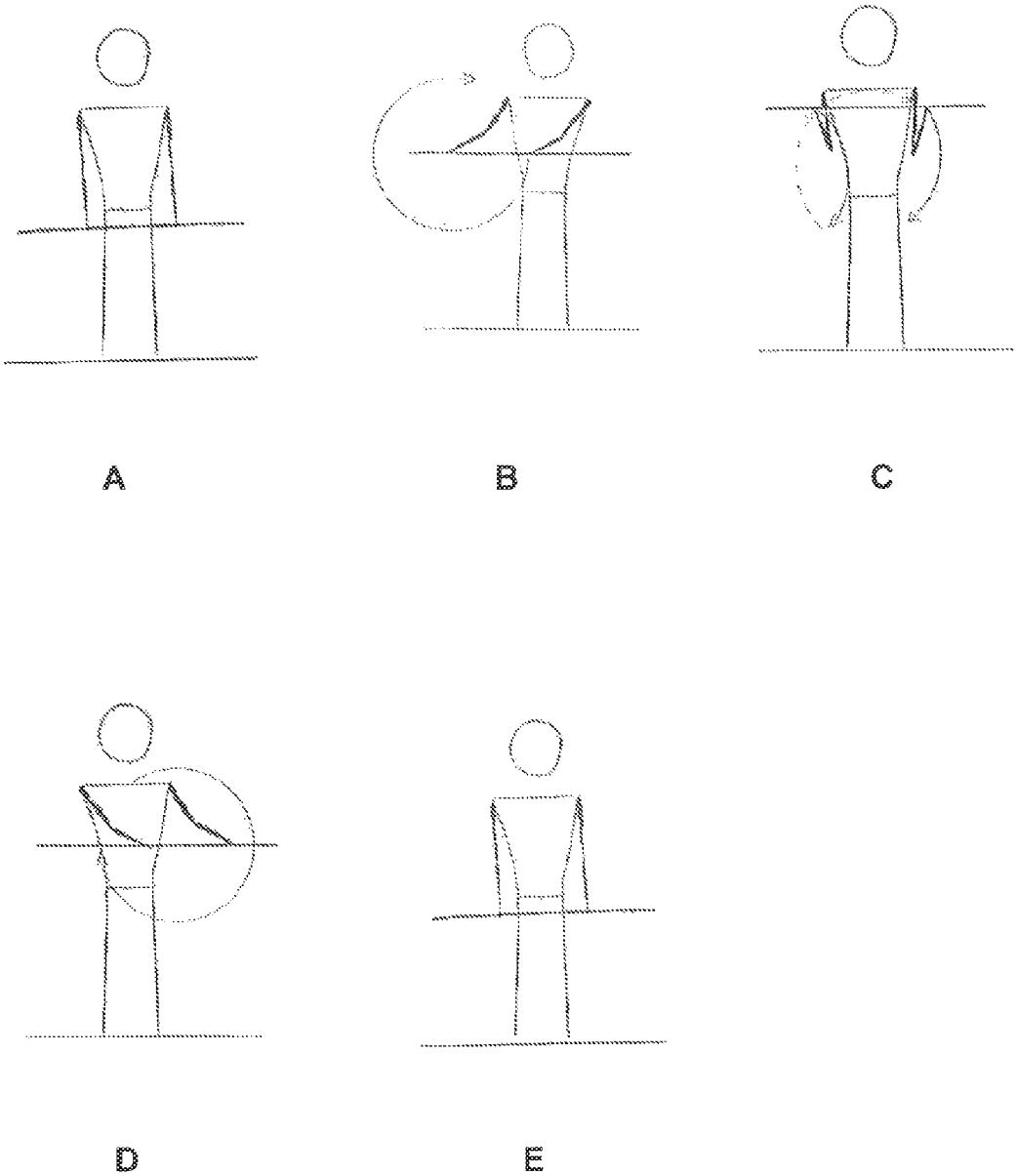
FIG. 5 is a diagrammatic representation of another embodiment of a method of exercising in accordance with the present disclosure.

Turning to FIG. 5, another embodiment of a method of exercising is illustrated wherein the present improved exercise bar is used to execute exercises involving rotational movements of the bar in the frontal plane of the body.

This embodiment can be termed a "Frontal Plane Bar Curl Rotation", which starts by (FIG. 5A) standing with the feet positioned shoulder width apart, knees slightly bent, holding the bar in front of the upper thighs and parallel with the floor. The grip is supinated and slightly wider than shoulder width for this example.

During the movement, the bar ascends (FIG. 5B), while the arms and elbows simultaneously flex and rotate until the bar is in line with the upper chest area (in proximity to the collar bone line and parallel to it) (FIG. 5C). In the second part of the movement, the bar descends (FIG. 5D) following the same radius until it is in line with the upper thighs, and again parallel with the floor (FIG. 5E).

Embodiment

Frontal Plane 180° Bar Spin

Figure 6:
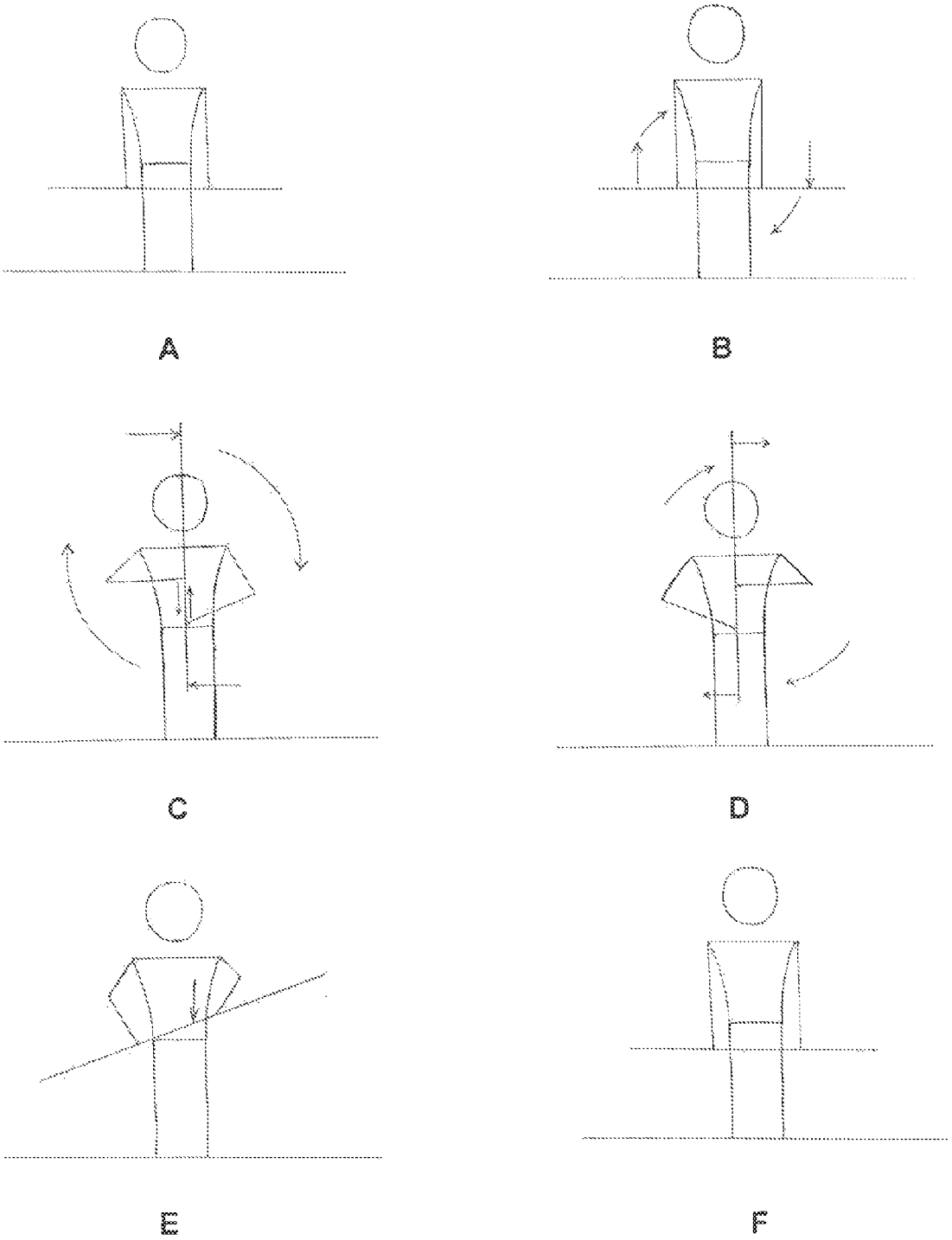
FIG. 6 is a diagrammatic representation of yet another embodiment of a method of exercising in accordance with the present disclosure.

Turning to FIG. 6, yet another embodiment of a method of exercising is illustrated wherein the present improved exercise bar is used to execute various spinning movements and grip changes that would be dangerous or even impossible to perform using plate loaded bars.

This embodiment can be termed a "Frontal Plane 180° Bar Spin" and starts by standing with the feet shoulder width apart, knees slightly bent, holding the bar in front of the upper thighs and parallel with the floor (FIG. 6A). The grip is mixed (one hand supinated, one hand pronated). The movement begins with a simultaneous push created with the pronated hand and pull created with the supinated hand that generates a spinning of the bar in the frontal plane of the body and around the pronated grip side (FIG. 6B).

At an intermediate point during the bar spin, when the bar is perpendicular with the ground (FIG. 6C), there is a grip change that takes place through a sliding technique, namely the upper hand slides down and grips the bar advantageous for pronation, while the initially lower hand slides up and grips the bar advantageous for supination (FIG. 6D). The movement ends (FIGS. 6E and F) in the same position as the initial position except the hand grip is reversed due to the sliding grip change half way through the motion.

Embodiment

Chop Lift Exercise

Figure 7:
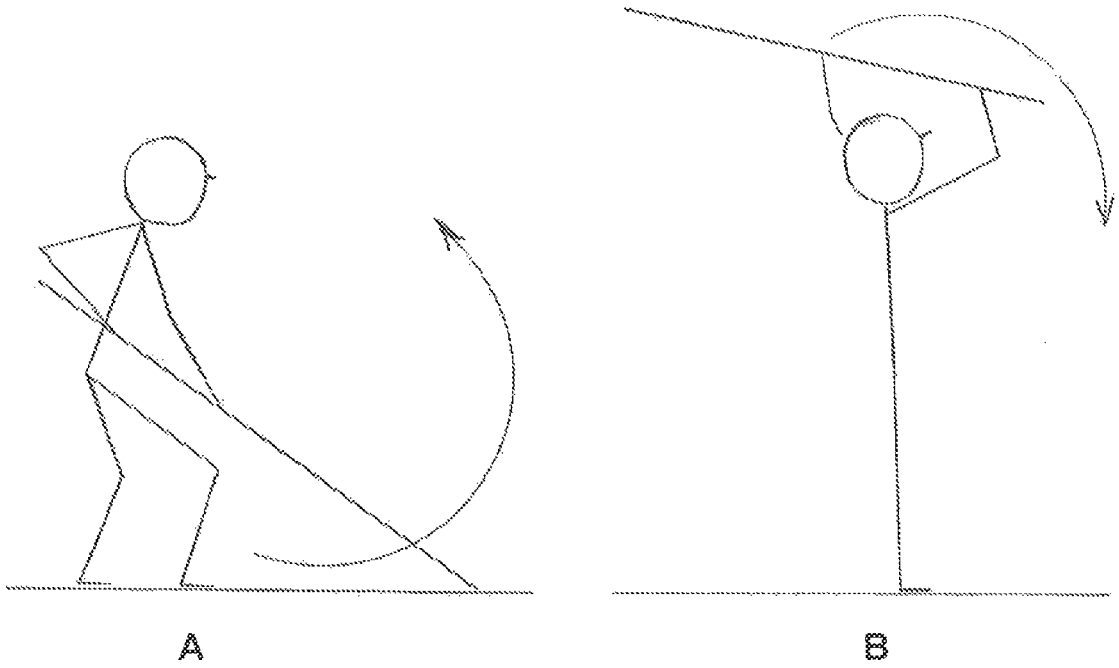
FIG. 7 is a diagrammatic representation of yet another embodiment of a method of exercising in accordance with the present disclosure.

Turning to FIG. 7, yet another embodiment of a method of exercising is illustrated wherein the present improved exercise bar is used to execute exercises that involve gripping the bar at one end only.

This embodiment, which can be termed the "Chop Lift Exercise", starts with the knees slightly bent and placed one in front and the other and with the feet shoulder width apart. For this example the left foot is in front. In the starting position (FIG. 7A), the weight is placed 70% on the right foot and 30% on the left foot. The bar is angled 20° to 60° away from the sagittal plane of the body and with the distal end in contact with the ground. The bar is also angled 25° to 65° towards the ground. The proximal end of the bar is in contact with the superior and lateral aspect of the right thigh. The trunk is flexed and rotated towards the bar; for this example, the right side. The arms grip the proximal third section of the bar using a mixed grip, namely right arm supination and farther away from the body, left arm pronation and closer to the body.

The movement begins by rotating the bar towards the left hip until the bar is parallel with the ground. This rotation continues until the bar is raised over head. The knees, hip and trunk are extending to accompany the last portion of the lift. In the final position (FIG. 7B), the bar is held directly overhead and the elbows are slightly bent. The knees bend again in this position as well. During the lift the body weight is transferred from the right foot to the left but in the final position the body weight is equally distributed on both feet.

Embodiment

Kayak Bar Spin

Figure 8:
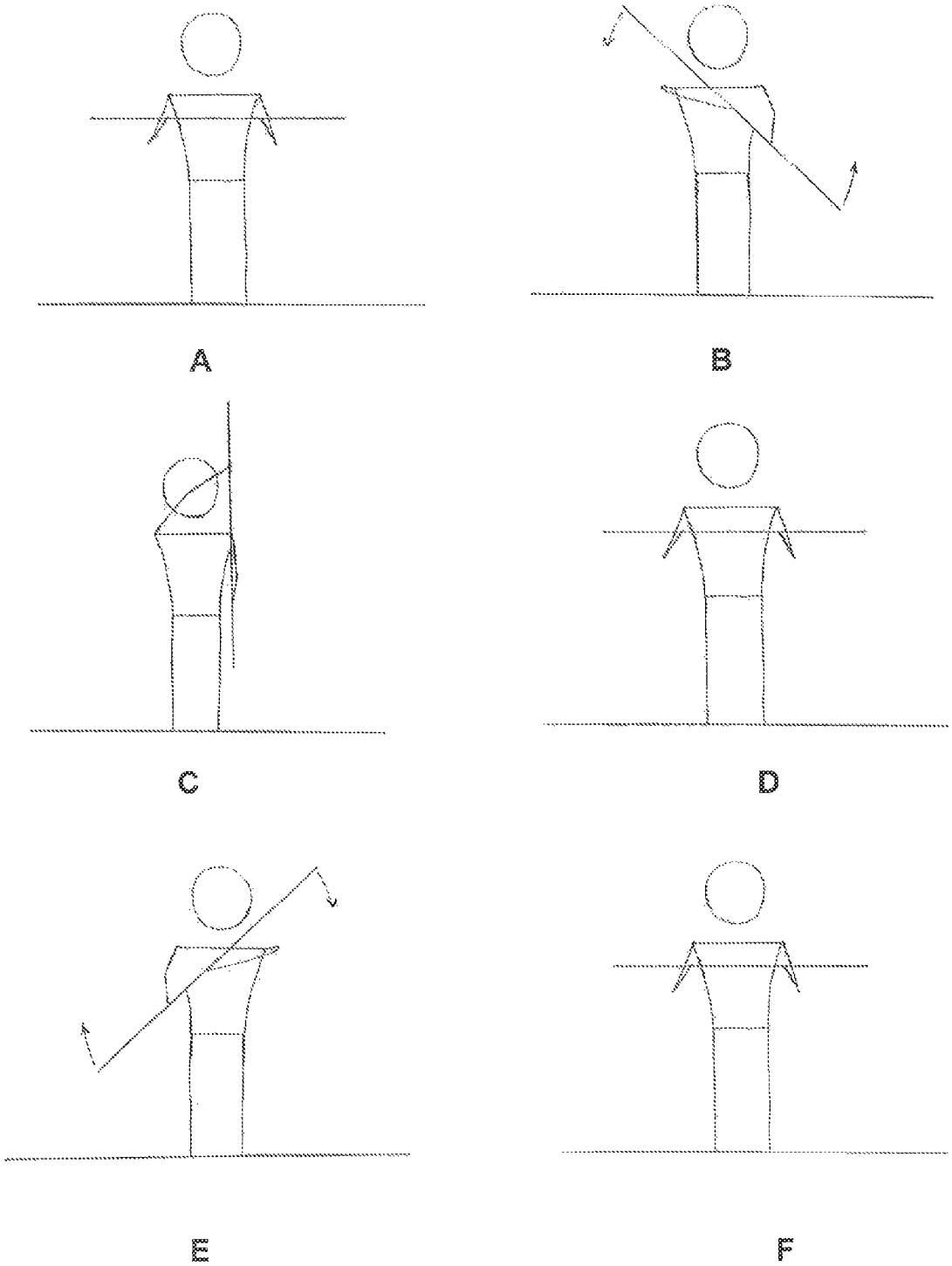
FIG. 8 is a diagrammatic representation of yet another embodiment of a method of exercising in accordance with the present disclosure.

Turning to FIG. 8, yet another method of exercising is illustrated wherein the present improved exercise bar is used to execute multi-planar and multi-axial movements performed under load, due to the advantageous weight, shape and unitary construction of the bar.

This embodiment, which can be termed "Kayak Bar Spin" is an exercise that combines movements of the body and the bar in frontal sagittal and transverse planes at various points during the exercise. In the start position (FIG. 8A), the body is upright with the feet shoulder width apart and the knees slightly bent. The bar is held in front of the chest with the elbows bent at 90°, using a pronated grip. In the first part of the movement (FIG. 8B), the following movements occur: bilateral knee bend; right to left hip weight transfer; left trunk rotation and side bend; right arm flexion, adduction and internal rotation; left arm extension, abduction and external rotation.

The movement then continues (FIG. 8C) with a further bilateral knee bend, left arm flexion, abduction and internal rotation, right arm further adduction flexion and external rotation. During this time, the bar is moved from the front of the body forward, to the side and then back across all three planes of motion; namely, frontal, sagittal and transverse. Following this, the movement returns to the start position (FIG. 8D). Then, the bar is pushed in front of the body while rotating the trunk towards the right side (FIG. 8E) and reversing all the movements previously described. The exercise ends in the same position as the starting position (FIG. 8F).

Embodiment

Bar Sagittal Thrust

Figure 9:
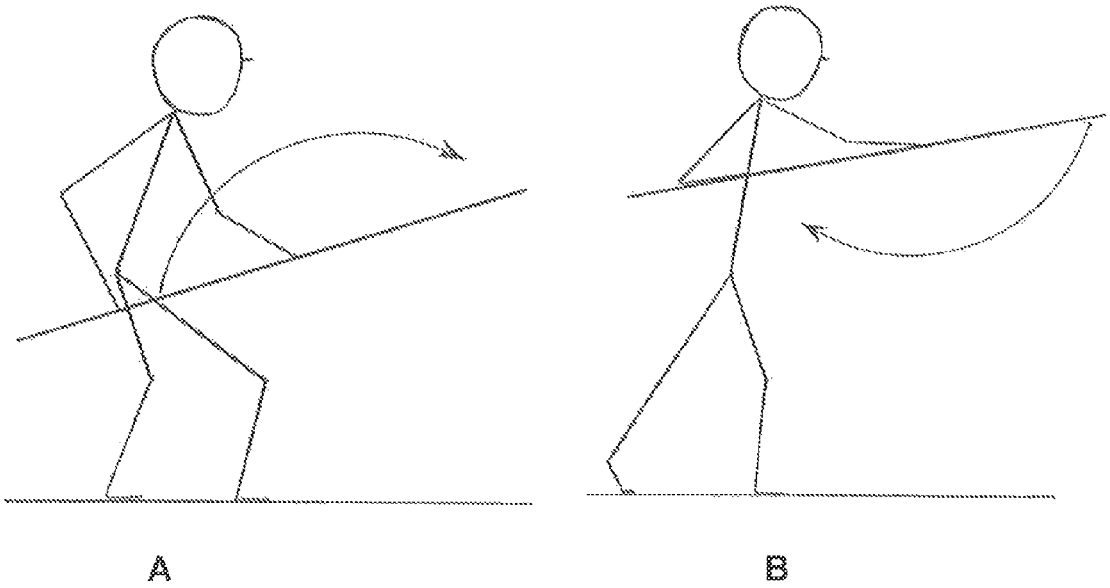
FIG. 9 is a diagrammatic representation of yet another embodiment of a method of exercising in accordance with the present disclosure.

Turning to FIG. 9, yet another embodiment of a method of exercising is illustrated wherein the present improved exercise bar is used to execute upper body, lower body or combined exercises including rapid acceleration and/or deceleration components under specific load.

This embodiment, which can be termed the "Bar Sagittal Thrust" exercise starts, (FIG. 9A), in a standing position with the left leg in front of the right leg about the distance of a shoulder width, with the knees slightly bent and the weight at least 60% on the rear leg. The grip is mixed and placed on the proximal third of the bar, relative to the body (the end of the bar closest to the body). The right rear arm grips the bar at hip height, while the left forward arm grips the bar at the solar plexus level. The forward thrust movement (FIG. 9B) involves a quick bilateral knee, hip and trunk extension, along with the elevation of the centre of mass. The arms are simultaneously flexing at the shoulder joint and then extending at the elbow joint while raising the bar until the proximal end reaches the chest level. After this quick action, both arms will pull the bar back to its original position (FIG. 9A), and the centre of gravity will again be lowered, along with the bilateral bend of the legs.

Embodiment

Bar Push-up on the BOSU® Ball

Figure 10:
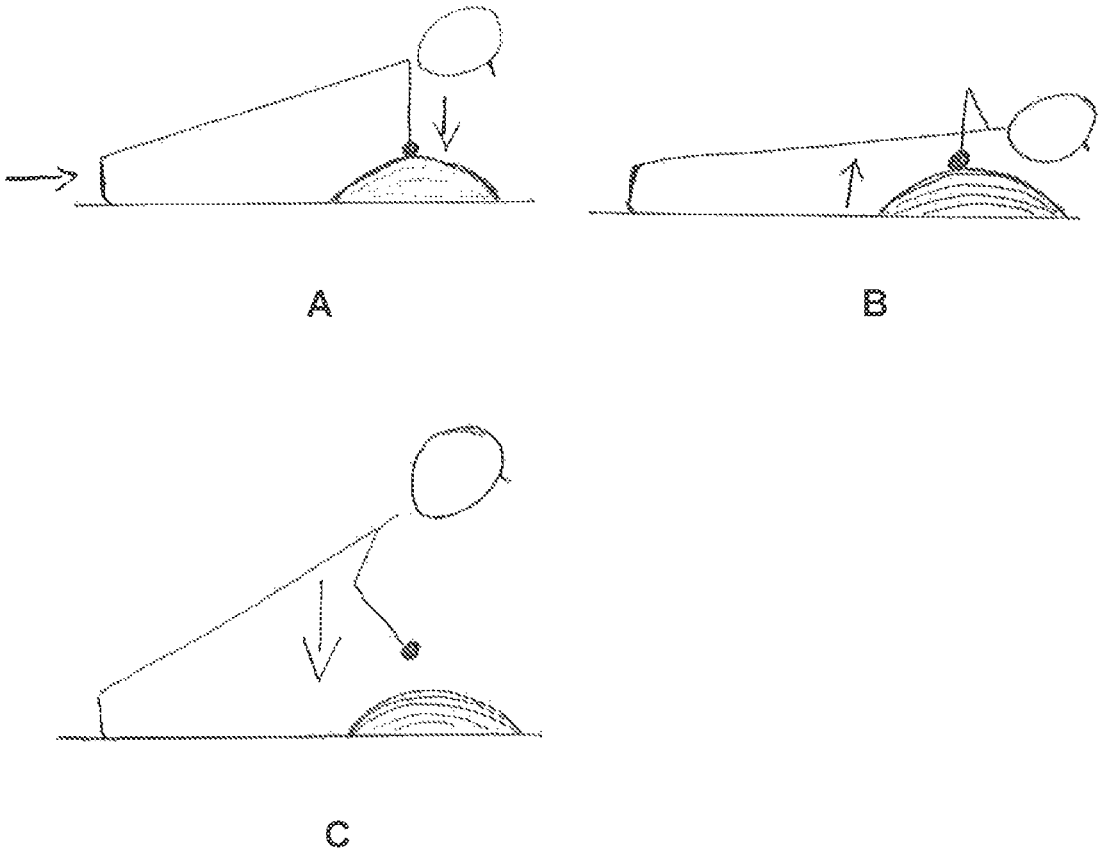
FIG. 10 is a diagrammatic representation of yet another embodiment of a method of exercising in accordance with the present disclosure.

Turning to FIG. 10, yet another embodiment of a method for exercising is illustrated wherein the present improved exercise bar is used to execute plyometric exercises under load. As discussed above, the present improved exercise bar was designed to be specifically used in preparation for, or during, plyometric exercises.

This embodiment is termed the "Bar Push-up on the BOSU® Ball", or any other appropriate cushioning surface, wherein the starting position, (FIG. 10A), the improved exercise bar is held shoulder-width apart or wider with both hands using the pronated grip on top of the BOSU® ball (also known as an half hemispherical exercise ball) or any other appropriate cushioning surface. The exercise begins by quickly transferring more body weight to the arms through the energetic and bilateral plantar flexion movement (FIG. 10A). Then, the bilateral arm flexion follows with further transfer of weight to the arms. When enough bending of the arms has been achieved, depending on individual strength differences, a rapid push movement (FIG. 10B) follows by extending the elbows and pushing the bar down into the BOSU® ball or any other appropriate cushioning surface. Again, depending on individual strength differences, the improved exercise bar can further be pulled towards the chest at the end of the push movement (FIG. 10C).

The advantage of using the improved exercise bar in this embodiment for the beginner is that it provides a counter-force against the arm separation force when loading the trunk during the landing phase. For the advanced individual, it provides an additional weight that can be pulled at the end of the push-up. For both, the load can be adjusted by selecting the correct size bar.

Embodiment

Plyolift Training Method

One embodiment of the method of exercising using the apparatus disclosed herein can also be referred to as the Plyolift Training Method. The Plyolift Training Method is designed to increase the muscular and skeletal system's force transmission capabilities by way of improving joint stability, muscular control and dynamic postural control. This can be later used in conjunction with and/or in preparation for activities including but not limited to plyometric work, sports that require throwing techniques, and martial arts, among other physical activities, sports and exercises.

Figure 13:
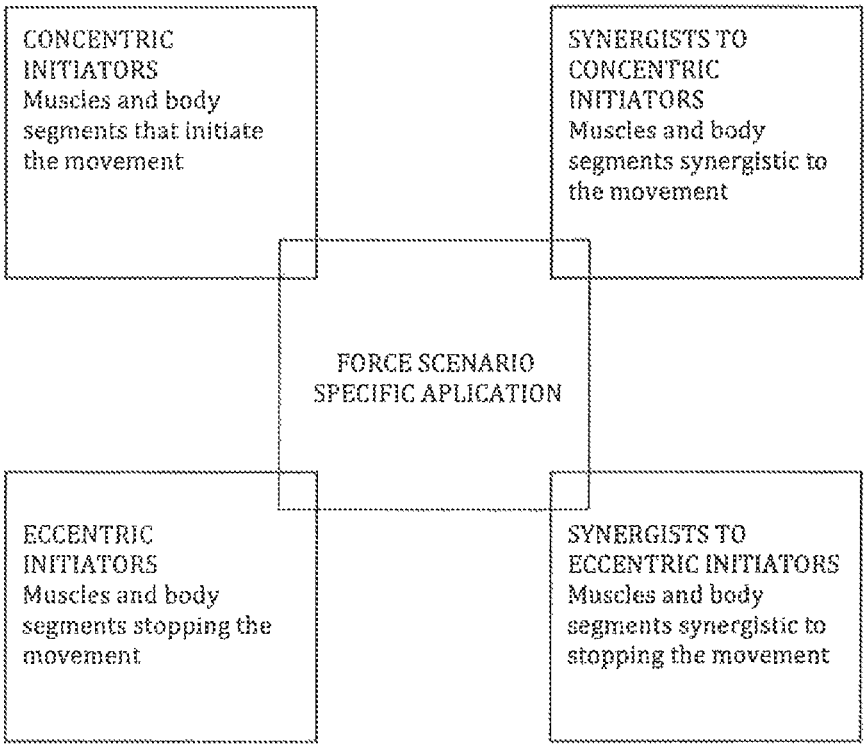
FIG. 13 is a schematic representation of a force application scenario of at least one embodiment of the Plyolift Training Method in accordance with the present disclosure.

While many training systems are focused on increasing the muscle force production capabilities, a main focus of the Plyolift Training Method is to ensure that the forces created through muscle contraction are effectively transmitted between adjacent segments or all the way across the body, depending on the specifics of the force loading scenario. Therefore the forces acting on the body are controlled by creating specific loading scenarios by way of choosing to load muscles concentrically or eccentrically at certain instants during a selected movement, as illustrated in FIG. 13. Furthermore, the components of magnitude, direction and duration of the force applied are also strategically manipulated by choosing the desired exercise and bar (as discussed above and illustrated at FIGS. 4-10).

Figure 14:
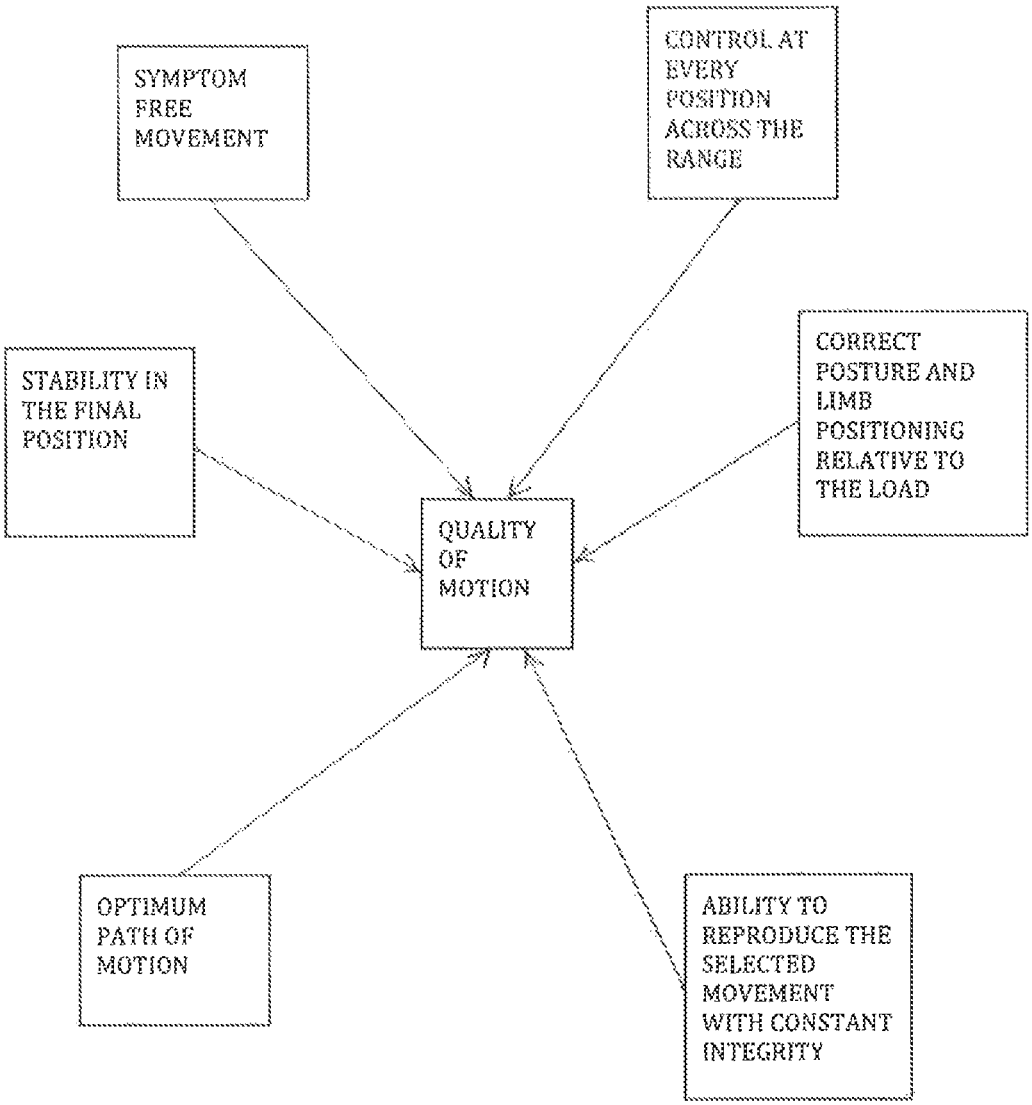
FIG. 14 is a schematic representation of a quality of motion evaluation scenario of at least one embodiment of the Plyolift Training Method in accordance with the present disclosure.

While traditional weightlifting provides mostly isolation exercises, the Plyolift Training Method requires the body to integrate in a movement as many muscles as possible that can contribute to the improved execution of the selected movement. This synergistic way of loading the body adds a novel training challenge and requires the body to adapt to a more dynamic and diverse force application environment. Evaluation consisting of both a range of motion (FIGS. 15 and 16) and quality of motion assessment (FIG. 14) is performed before starting the Plyolift specific training (FIGS. 4-13).

Figure 15:
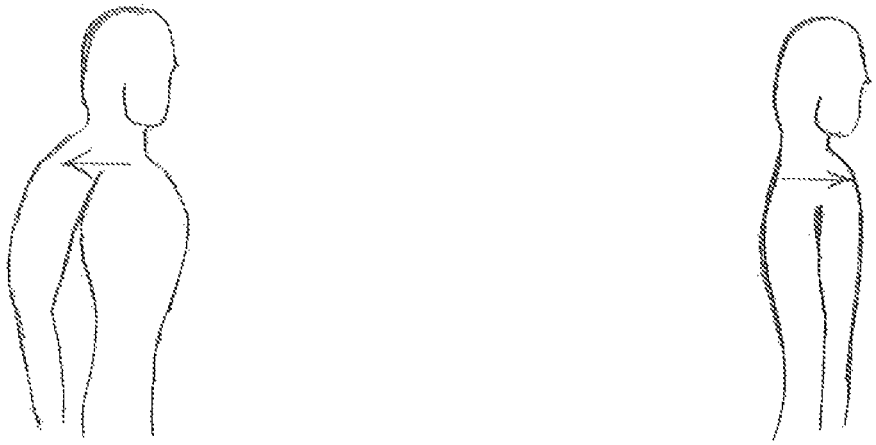
FIG. 15 is a diagrammatic representation of a shoulder range of motion assessment of at least one embodiment of the Plyolift Training Method in accordance with the present disclosure.
Figure 15:
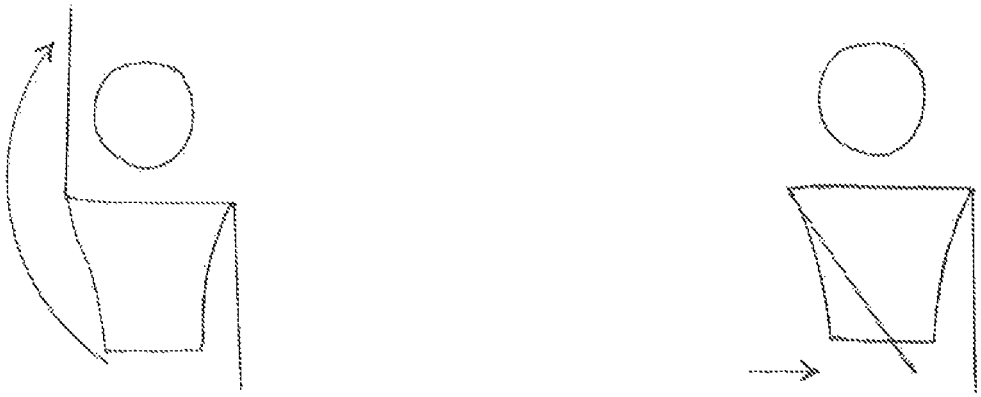
Figure 15:
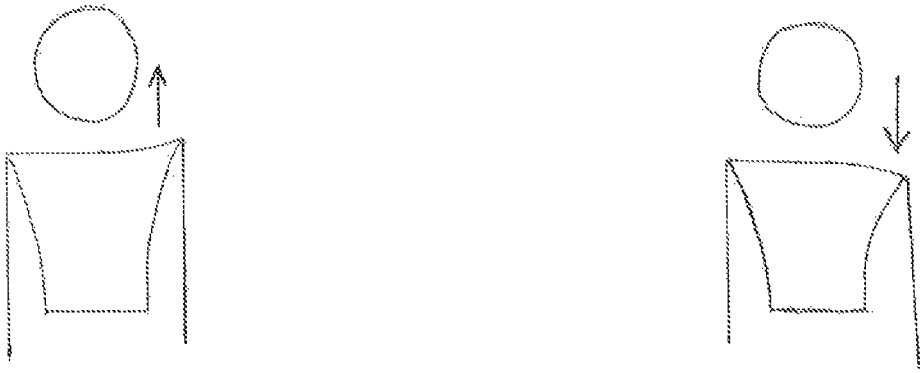
Figure 16:
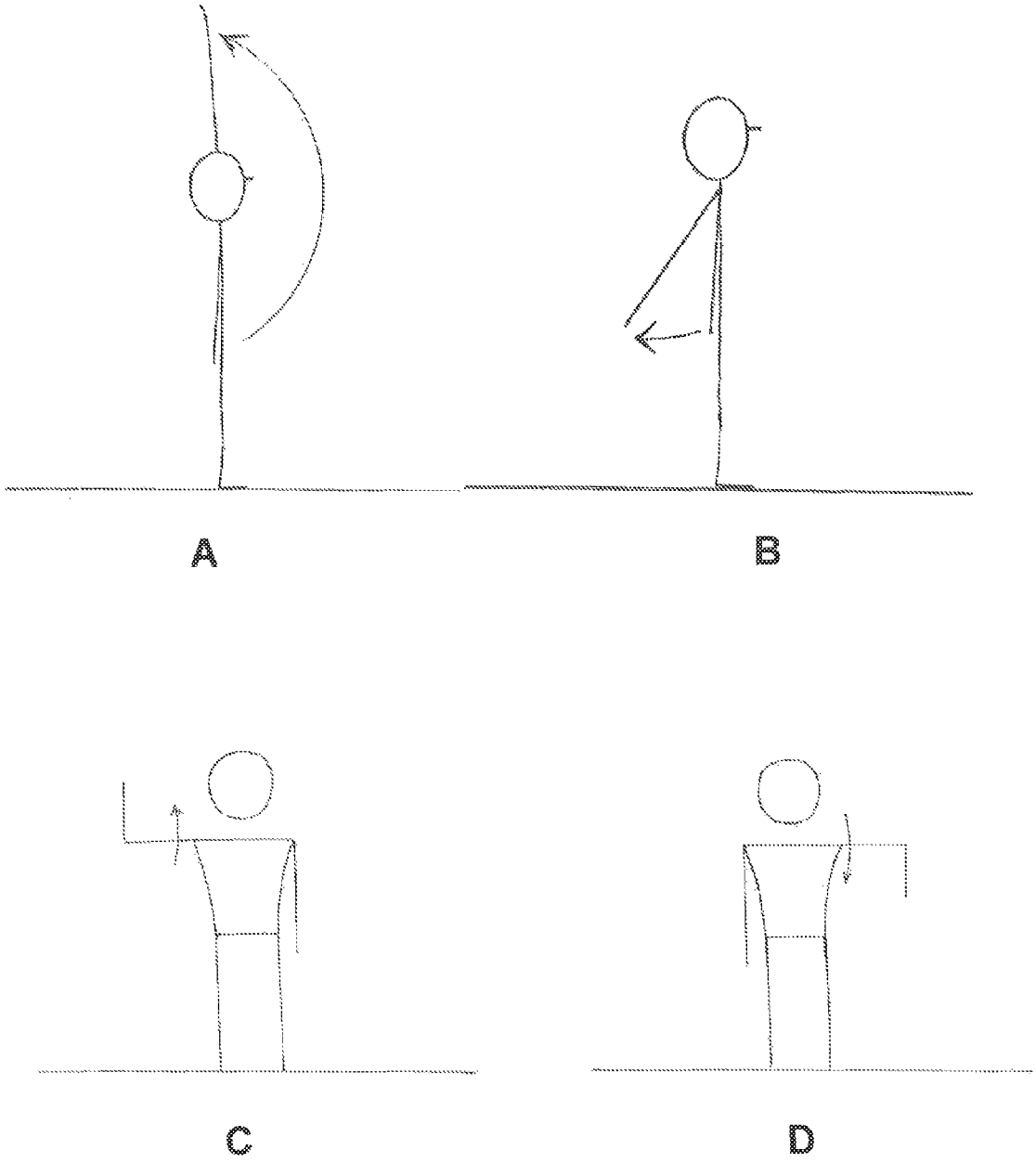
FIG. 16 is another diagrammatic representation of a shoulder range of motion assessment of at least one embodiment of the Plyolift Training Method in accordance with the present disclosure.

One example of range of motion assessment performed on the shoulder complex is illustrated in FIGS. 15 and 16, and encompasses the following evaluation points: shoulder flexion (FIG. 16A), shoulder extension (FIG. 16B), humeral external rotation (FIG. 16C), humeral internal rotation (FIG. 16D), shoulder protraction and retraction (FIG. 15A), shoulder elevation and depression (FIG. 15B), humeral abduction and adduction (FIG. 15C). This initial assessment is used to understand the current health and performance levels of the person being assessed. Depending upon the findings of this initial assessment and in conjunction with other relevant information such as the individual health history, the Plyolift Training Method can immediately start or alternatively a re-evaluation might be necessary, as illustrated in FIG. 11.

Figure 11:
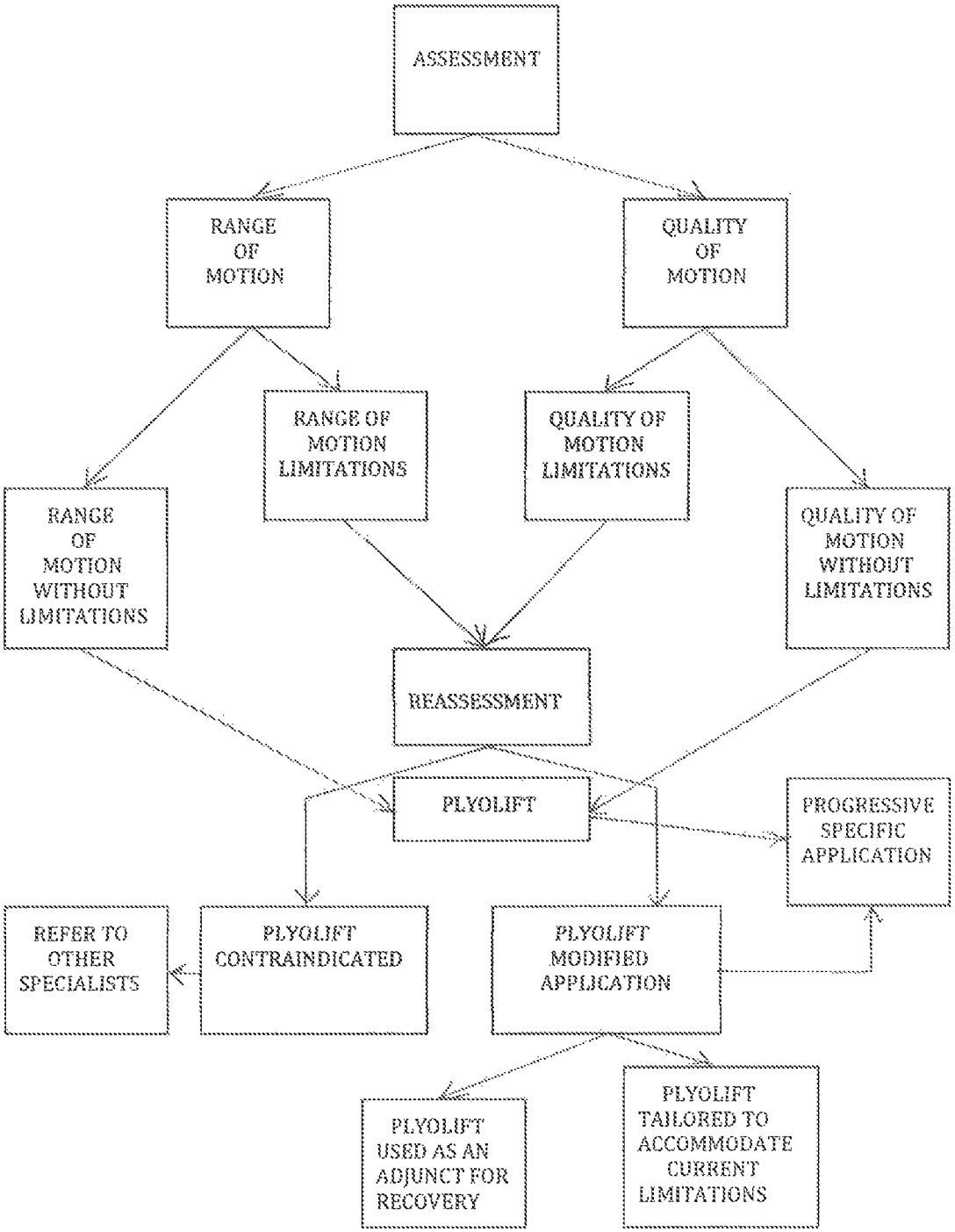
FIG. 11 is schematic representation of a path of application of at least one embodiment of the Plyolift Training Method in accordance with the present disclosure.
Figure 12:
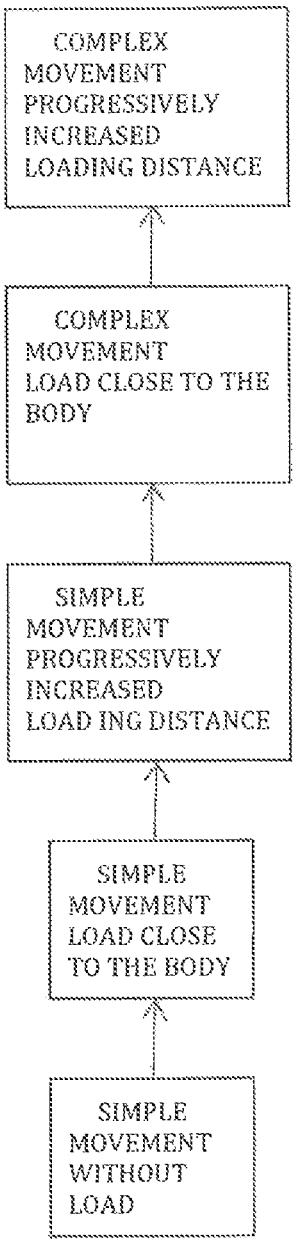
FIG. 12 is a schematic representation of an exercise progression of at least one embodiment of the Plyolift Training Method in accordance with the present disclosure.

In case of a re-evaluation, further testing will be performed until sufficient findings are collected in order to determine whether the person being evaluated can start a modified version of the Plyolift Training Method or whether they must be referred to other specialists for further investigation or treatment, as seen at FIG. 11. These findings are then linked together and an overall health and performance profile of the person being assessed is determined. Based on this profile, a trained Plyolift specialist can determine the most appropriate starting point for applying progressive and specific Plyolift exercises and method of training (FIGS. 11-13).

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

I claim:

1. An exercise bar comprising:

an axially extending, cylindrical handle section having a first end and a second end, and a diametrically opposed consistent circular cross-section across an entire axial length of the handle;

at least one of a first frustoconical end and a second frustoconical end, said first frustoconical end having a first end having a first circular cross-section and smoothly abutting said first end of said handle section and a distal end, the first frustoconical end gradually radially expanding to a second circular cross-section at a point between the first end and the distal end of the first frustoconical end, said second frustoconical end having a first end having a first circular cross-section and smoothly abutting said second end of said handle section and a distal end, the second frustoconical end gradually radially expanding to a second circular cross-section at a point between the first end and the distal end of the second frustoconical end;

wherein the diametrically consistent circular cross-section is the same as the first circular cross-section of the first frustoconical end and the first circular cross-section of the second frustoconical end; and wherein the diameter of the first circular cross-section of each of said first frustoconical end and the second frustoconical end is smaller than the diameter of the second circular cross-section of each first frustoconical end and the second frustoconical end.

2. The exercise bar of claim 1, wherein said first frustoconical end has a first diameter at said first end of said first frustoconical end equal to the diameter of said handle section and a larger second diameter at a point between said first end of said first frustoconical end and said distal end of said first frustoconical end and said second frustoconical end has a diameter at said first end of said second frustoconical end equal to the diameter of said handle section and a larger second diameter at a point between said first end of said second frustoconical end and said distal end of said first second end.

3. The exercise bar of claim 1, wherein said handle section has a knarled finish.

4. The exercise bar of claim 1, wherein said handle section is rubberized.

5. The exercise bar of claim 1, wherein said exercise bar is manufactured by a process selected from the group consisting of casting, milling and lathing.

6. The exercise bar of claim 1, wherein said exercise bar is manufactured from a material selected from the group consisting of aluminum, stainless steel, cast iron, wood, galvanized steel and carbon steel.

7. A kit comprising the improved exercise bar of claim 1, the kit further comprising instructions for using the improved exercise bar.

8. A method of dynamically exercising a targeted muscle, the method comprising exercising the targeted muscle in at least two planes of motion relative to a skeletal joint adjacent to the targeted muscle by selecting the appropriate loading scenario according to current available range of motion characteristics and muscular ability to tolerate force by using the exercise bar of claim 1.

9. The method of exercising targeted muscles of claim 8, by using exercises specifically designed to improve the body's force transmission capabilities, the method comprising:

a) assessing a range of motion, b) assessing a quality of motion;

c) strategically utilizing progressive multi-planar movements under load, by manipulating an improved exercise bar;

d) strategically utilizing multi-axial movements put under load by said improved exercise bar;

e) strategically utilizing multi-directional movements put under load by manipulating said improved exercise bar; and f) exercising the targeted muscles synergistically and under progressive loading relative to involved skeletal joints by manipulating said exercise bar.

10. The method of exercising targeted muscles of claim 8, by moving the exercise bar by supplying a force to generate a selected movement of the exercise bar to dynamically train targeted muscles, said movement configured to manipulate said exercise bar under progressive loading in multiple planes relative to adjacent joints of said targeted muscles.

11. The method of exercising targeted muscles of claim 8, which comprises assessing motion characteristic of targeted muscles comprising the steps of:

a) performing an assessment of motion characteristic;

b) determining limitations of said motion characteristic;

c) comparing said limitations of said motion characteristic to a threshold; and wherein-if said limitations of said motion characteristic do not exceed said threshold;

selecting an exercise for dynamically training the targeted muscles in multiple planes relative to adjacent skeletal joints.

12. The method of claim 11, wherein said motion characteristic is selected from the group consisting of quality of motion, range of motion and progressive loading.

13. The method of claim 12, wherein quality of motion is determined from at least one factor, wherein said at least one factor is selected from the group consisting of free movement, control at every position across a range, correct posture and limb positioning relative to a load, ability to reproduce the selected movement with constant integrity, optimum path of motion and stability in a final position.

* * * * *